US005743793A

United States Patent [19]

Parks et al.

[11] Patent Number: 5,743,793

[45] Date of Patent: Apr. 28, 1998

[54] AIRFLOW DIFFUSER APPARATUS FOR USE WITH A PAINT BOOTH

[75] Inventors: Steven James Parks, Northville; Ernest Henry Tong, Canton, both of Mich.

[73] Assignee: Ford Global Technologies, Inc., Dearborn, Mich.

[21] Appl. No.: 786,940

[22] Filed: Jan. 23, 1997

[51] Int. Cl.[6] ..... B05B 15/12

[52] U.S. Cl. ..... 454/52; 55/413

[58] Field of Search ..... 454/50, 52; 55/385.2, 55/413, 414; 118/326

[56] References Cited

U.S. PATENT DOCUMENTS

| | | | |
|---|---|---|---|
| 4,023,472 | 5/1977 | Grunder et al. | 55/385.2 X |
| 5,213,595 | 5/1993 | Kim | 55/385.2 X |
| 5,397,394 | 3/1995 | Orr . | |
| 5,480,349 | 1/1996 | Kolta | 454/52 |
| 5,493,753 | 2/1996 | Rostamo | 55/413 X |
| 5,512,017 | 4/1996 | Gore et al. . | |

*Primary Examiner*—Harold Joyce

*Attorney, Agent, or Firm*—Lorraine S. Melotik, Esq.; Roger L. May, Esq.

[57] ABSTRACT

An airflow diffuser apparatus for controlling the airflow exiting a filter unit used in a paint booth. The airflow diffuser apparatus includes a diffuser formed of a plate positioned underneath the filter unit to diffuse the airflow exiting the filter unit to provide a more uniform airflow in the paint booth.

8 Claims, 2 Drawing Sheets

AIRFLOW DIFFUSER APPARATUS FOR USE WITH A PAINT BOOTH

BACKGROUND OF THE INVENTION

1. Field of the Invention

The present invention relates generally to a vehicle paint booth, and more specifically to, an airflow diffuser apparatus for use with a paint booth.

2. Description of the Related Art

Typically, a fully or partially assembled motor vehicle is transported, via a conveyor, into a paint booth wherein a desired color or colors are sprayed onto the motor vehicle either by a painter or a mechanized operation. During the paint spraying operation, paint sprays and mists accumulate within the paint booth and must be removed. Therefore, it is necessary to provide an air supply and an extraction system to supply air to, and remove paint laden air from the paint booth during and after the spraying operation.

If the airflow through the paint booth is not uniform, undesirable turbulence and randomly directed air streams are generated that carry paint droplets, mist, fumes and dust, etc., throughout the paint booth. Various attempts have been made to provide a paint booth that controls and directs the large quantities of air entering and exiting the paint booth. Therefore, there is a need in the art to provide a paint booth which controls and spreads the airflow such that a uniform airflow is produced throughout the interior of the paint booth.

SUMMARY OF THE INVENTION

Accordingly, the present invention is an airflow diffuser apparatus for uniformly spreading the airflow exiting a filter unit such that the uniform spread provided by the airflow diffuser apparatus provides a uniform airflow to the bottom of the plenum. In the present invention, the airflow diffuser apparatus is a diffuser connected adjacent to the filter unit.

One advantage of the present invention is that the airflow diffuser apparatus includes a plate positioned underneath the filter unit to diffuse the airflow pattern created by the filter unit. A further advantage of the present invention is that the plate is attached to and supplied with the filter unit and is thus part of a replaceable assembly.

Other features and advantages of the present invention will be readily appreciated as the same becomes better understood after reading the subsequent description taken in conjunction with the accompanying drawings.

DESCRIPTION OF THE PREFERRED EMBODIMENT(S)

Figure 1:
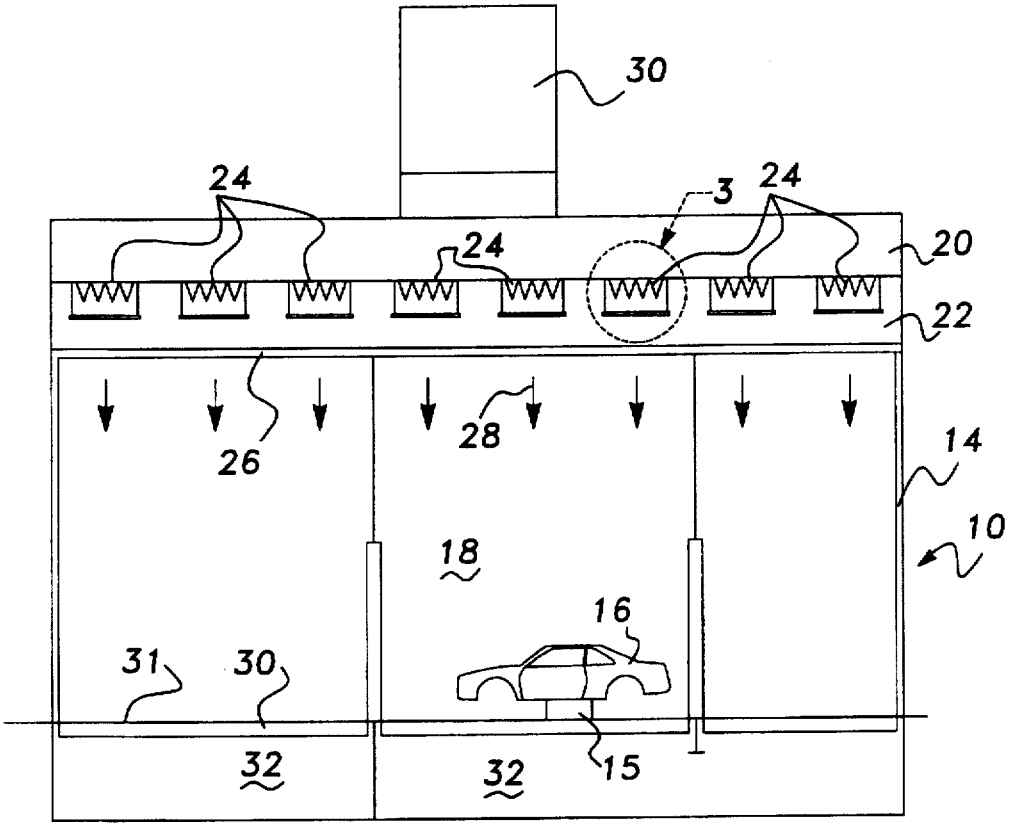
FIG. 1 is a schematic elevational view of a paint booth and airflow diffuser apparatus according to the present invention.
Figure 2:
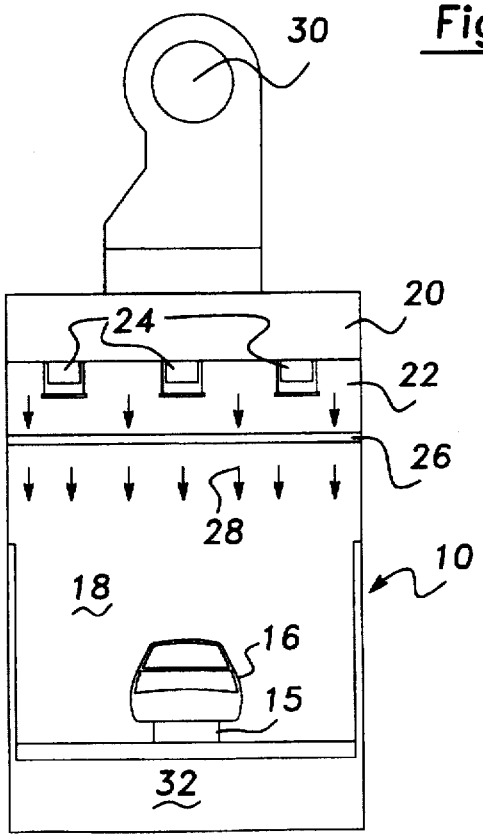
FIG. 2 is a schematic side view of the paint booth and airflow diffuser apparatus shown in FIG. 1.

Referring to FIGS. 1 and 2, a paint booth 10 having side walls 12 is shown. The paint booth 10 includes an opening 14 through which a motor vehicle 16 enters the interior 18 of the paint booth 10. Generally, the motor vehicle 16 is transferred through the paint booth 10 via a conveyor assembly 15 wherein the motor vehicle 16 is painted as it travels through the interior 18 of the paint booth 10.

The paint booth 10 includes an upper plenum 20 and a lower plenum 22 positioned adjacent the upper plenum 20. The upper plenum 20 receives air from an air supply 30. The air supply 30 fills the upper plenum 20 with air. The air exits the upper plenum 20 and enters the lower plenum 22 through a plurality of openings and filter units 24. The air exits the lower plenum 22 through a plurality of ceiling filters 26 and flows in the direction shown by the arrows 28. Thus, air is supplied to the interior 18 of the paint booth 10 for withdrawing paint laden air from the paint booth 10. The air continues to flow around the motor vehicle 16 and exits the paint booth 10 through a grating 30 in the floor 31 of the paint booth 10. Upon exiting the paint booth 10, the air travels through a scrubber assembly 32 which removes the paint from the air allowing the air to be either discharged or recirculated. Thus, it should be appreciated that the air enters the interior 18 or painting area through ceiling filters 26, is drawn downwardly in a generally vertical direction around the vehicle 16 being painted and out through the grating 30 into the scrubbers 32 for recirculation.

Figure 3:
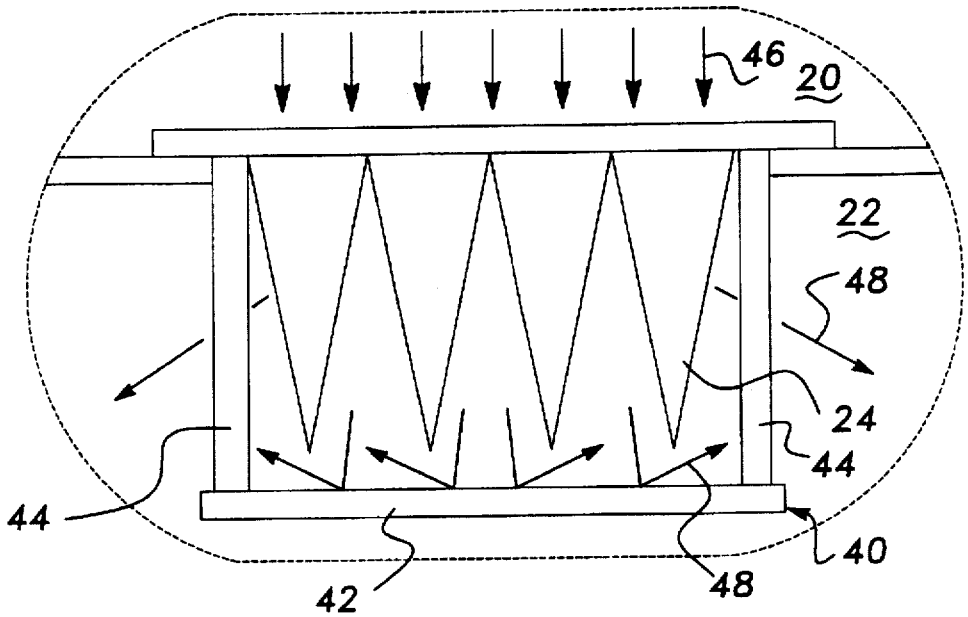
FIG. 3 is an enlarged view of the area shown in Circle 3—3 of FIG. 1.
Figure 4:
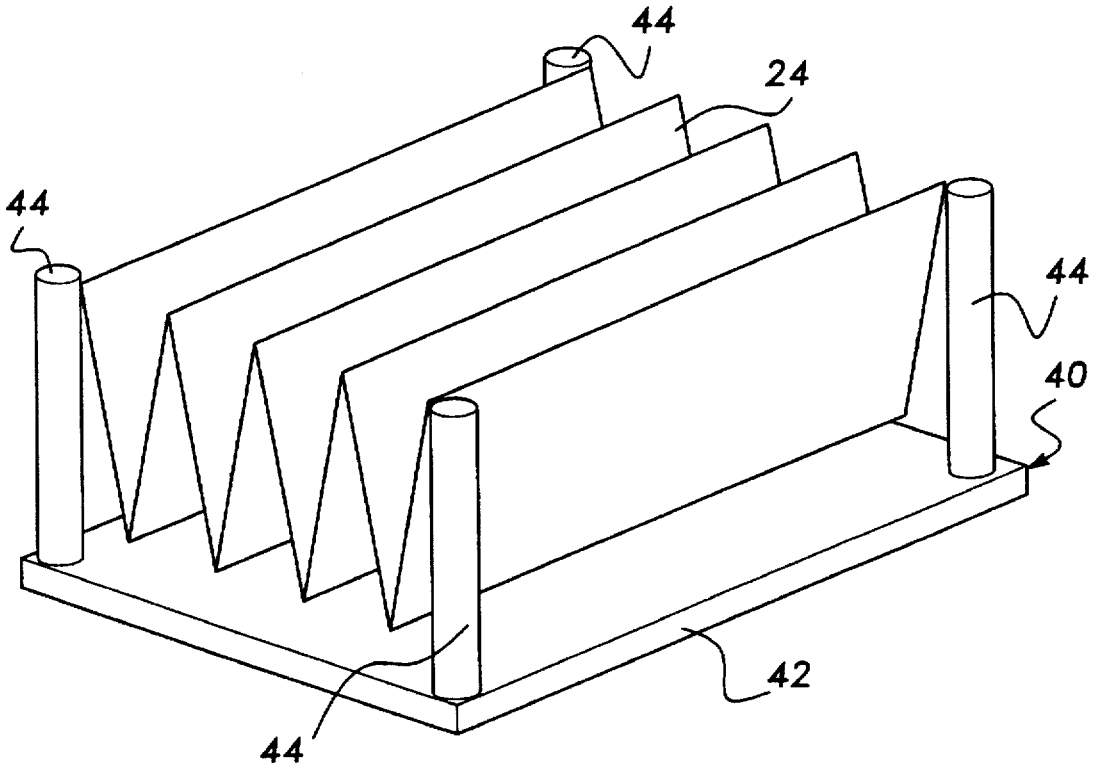
FIG. 4 is an enlarged perspective view of the airflow diffuser apparatus with portions removed for clarity.

Turning now to FIGS. 3 and 4, a filter unit 24 and diffuser, generally indicated at 40, for spreading an airflow passing through filter unit 24 and entering the lower plenum 22 is shown. The diffuser 40 helps to provide a uniform airflow to the ceiling filters 26. It should be appreciated that the airflow through the filter units 24 is diffused by the diffuser 40 from the high and low airflow velocity signature that was previously translated into the interior 18 of the paint booth 10.

As shown in FIG. 3, the diffuser 40 includes a plate 42 positioned underneath the filter unit 24. The plate 42 is held in position by a plurality of supports 44. In one embodiment, the plate 42 is formed as a solid, continuous plate member. In another embodiment, the plate 42 may be formed as a perforated plate member. In yet another embodiment, the plate 42 may be made of a material that is sewn to or an integral part of the filter unit 24 that stretches out across to form a plate member upon installation of the filter unit 24. Thus, the filter unit 24 and diffuser 40 form a unitary replaceable assembly.

As shown in FIG. 3, air enters the filter unit 24 in the direction shown by the arrows 46 and exits the filter unit 24 in the direction shown by the arrows 48. As shown, the air strikes the plate 42 and is forced to flow around the plate 42 and fills the lower plenum 22 in a more uniform manner which results in a more uniform flow exiting the lower plenum 22 through the ceiling filter 26. Depending upon the size and type of filter unit 24 used, the size and shape of the plate 42 may be varied to reduce any non-uniformity in the airflow path caused by the filter unit 24.

The present invention has been described in an illustrative manner. It is to be understood that the terminology which has been used is intended to be in the nature of words of description rather than of limitation.

Many modifications and variations of the present invention are possible in light of the above teachings. Therefore, within the scope of the appended claims, the present invention may be practiced other than as specifically described.

What is claimed is:

1. An airflow diffuser apparatus for use with a paint booth comprising:

a plenum;

an air supply, connected to and supplying air to said plenum;

a filter unit attached to said plenum wherein the air exits said plenum through said filter unit; and a diffuser positioned adjacent said filter unit for diffusing airflow exiting the filter unit, said diffuser including a plate having dimensions similar to dimensions of said filter unit and suspended adjacent said filter unit by a plurality of supports extending from said plenum and attached to said plate, said plate cooperating with said filter unit in a one to one basis and positioned such that the airflow exiting said plenum through said filter unit strikes said plate and is redirected around said plate to provide a more uniform airflow.

2. An airflow diffuser apparatus as set forth in claim 1 wherein said supports are attached to and extend from said filter unit such that said filter unit and said plate are installed in and removed from said plenum as a single unit.

3. An airflow diffuser apparatus as set forth in claim 1 wherein said diffuser is a planar plate secured under said filter unit.

4. An airflow diffuser apparatus for use with a paint booth comprising:

an air supply;

a plenum receiving air from said air supply;

a plurality of filter units connected to said plenum wherein air exits from said plenum through said filter units; and a plurality of diffusers associated with said filter units on a one to one basis and positioned adjacent said filter units to diffuse an airflow path created by air exiting said filter units, each of said diffusers including a planar plate having dimensions similar to dimensions of said filter unit and suspended adjacent said filter unit by support attached to and extending from said plenum on the end thereof and attached at an opposite end thereof to said planar plate.

5. An airflow diffuser apparatus as set forth in claim 4 including a plurality of supports connected to said plate to suspend said planar plate under said filter unit.

6. An airflow diffuser apparatus as set forth in claim 4 wherein said planar plate is connected to said filter unit by said support such that said filter unit and said diffuser form a unitary assembly which is installed and removed from said plenum as a single unit.

7. An airflow diffuser apparatus for use with a paint booth plenum comprising:

an air supply;

a plenum for receiving air from said air supply;

a plurality of filter units attached to said plenum and receiving air from said plenum, the air exiting said filter unit into a second plenum; and a plurality of plates having dimensions similar to dimensions of said filter units and corresponding to said filter units on a one to one basis, said plates being hung from said plenum by a plurality of supports attached at one end thereof to said plates such that said plates are suspended adjacent said filter units to diffuse the airflow exiting said filter units.

8. An airflow diffuser apparatus as set forth in claim 7 wherein said filter unit and said plate are formed of as a single unit such that said filter unit and said plate installed and removed as a single unit.

* * * * *